US005174510A

United States Patent [19]

Hughes

[11] Patent Number: 5,174,510

[45] Date of Patent: Dec. 29, 1992

[54] METHOD OF MOVING PARTICULATE MATTER FROM WITHIN A COMMINUTER

[75] Inventor: John H. Hughes, Montesano, Wash.

[73] Assignee: Com Corp, Inc., Montesano, Wash.

[21] Appl. No.: 772,478

[22] Filed: Oct. 7, 1991

Related U.S. Application Data

[60] Division of Ser. No. 425,508, Oct. 19, 1989, Pat. No. 5,064,127, which is a continuation of Ser. No. 191,020, May 6, 1988, abandoned.

[51] Int. Cl.[5] ..... B02C 4/30

[52] U.S. Cl. ..... 241/30

[58] Field of Search ..... 241/293, 294, 300, 85, 241/84.2, 87, 93, 253, 258, 257 R, 261, 30

[56] References Cited

U.S. PATENT DOCUMENTS

| | | | |
|---|---|---|---|
| 3,037,540 | 6/1962 | Bloomquist et al. | 241/294 X |
| 4,366,928 | 1/1983 | Hughes | 241/257 R X |
| 4,454,995 | 6/1984 | Bloomquist | 241/294 X |
| 4,477,028 | 10/1984 | Hughes | 241/257 R X |

FOREIGN PATENT DOCUMENTS 253059 6/1926 United Kingdom .

*Primary Examiner*—Mark Rosenbaum
*Attorney, Agent, or Firm*—Christensen, O'Connor, Johnson & Kindness

[57] ABSTRACT

In a comminuter for solid material, which includes a plurality of upright abrasive rolls mounted in a circle to form a comminuting chamber, an improvement in the comminuting roll includes the provision of a plurality of radially directed apertures formed in the surface of the rolls to pick up product from the interior of the comminuting chamber and deposit it adjacent the outer perimeter of the comminuter as the rolls rotate. The aperture may, but need not, extend through the roll. In operation, the particles of comminuted material enter the apertures in the surface of the roll. The roll is then rotated at a speed that is sufficient to provide a centrifugal force on the particular that dislodges them from the apertures when the aperture is positioned outwardly of the comminuting chamber. The particles that are picked up from the comminuting chamber are thus deposited outside the comminuting chamber.

2 Claims, 2 Drawing Sheets

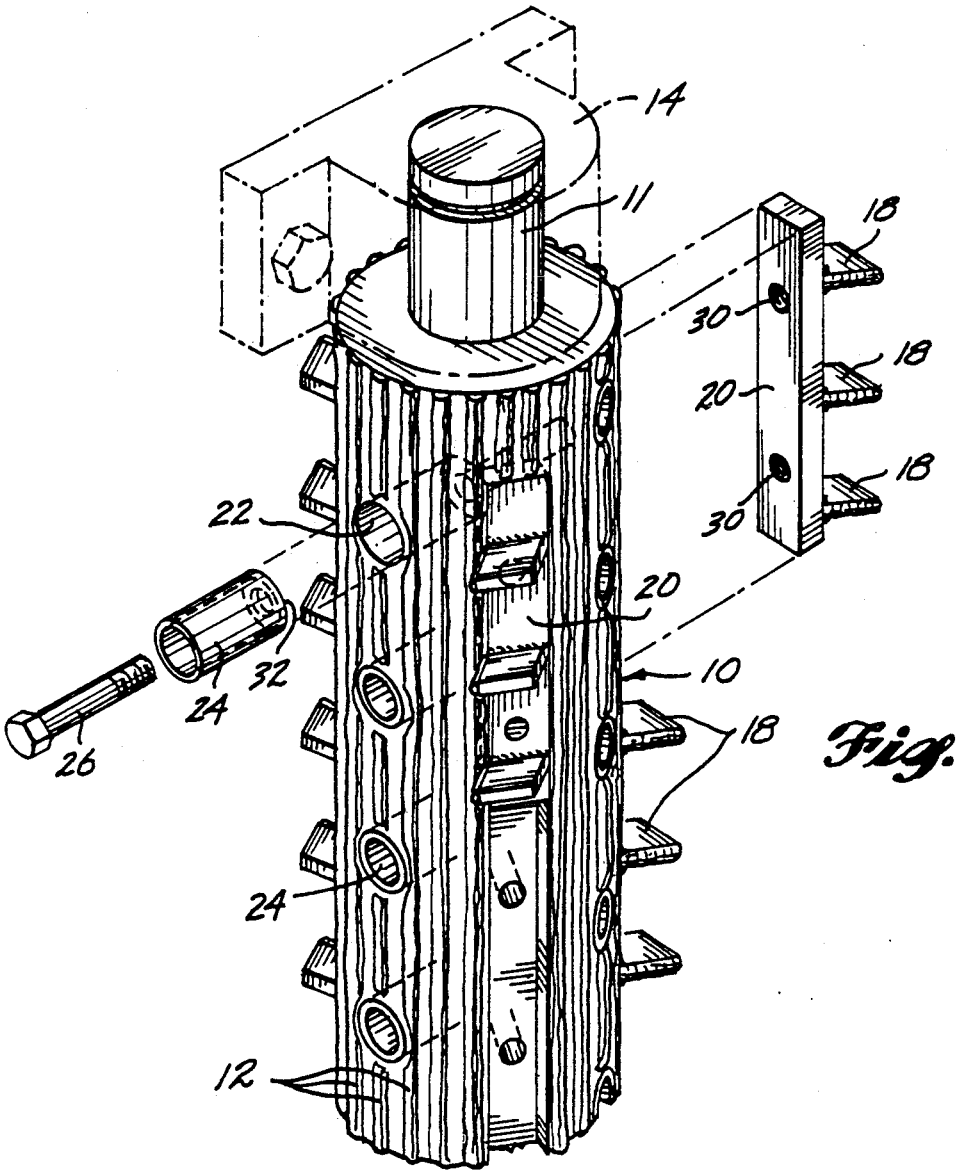
Fig. 1.
Fig. 2.
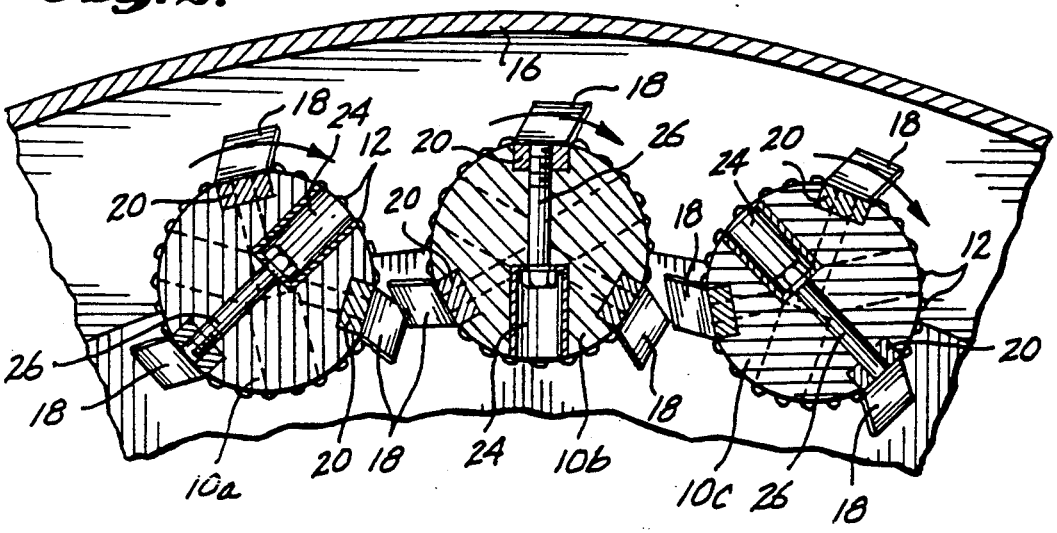

METHOD OF MOVING PARTICULATE MATTER FROM WITHIN A COMMINUTER

This is a divisional of prior application Ser. No. 07/425,508, filed Oct. 19, 1989, issued Nov. 12, 1991 as U.S. Pat. No. 5,064,127, which in turn is a continuation of application Ser. No. 191,020 filed on May 6, 1988, now abandoned, the benefit of the filing dates of which are hereby claimed under 35 USC §120.

BACKGROUND OF THE INVENTION

This invention relates to comminuters for pulverizing solid material and, more particularly, relates to an improved comminuter roll that assists in moving the end product out of the comminuter.

Comminuters can be used to pulverize a wide array of solid materials and a typical comminuter using pulverizing rollers is shown in U.S. Pat. No. 4,366,928, issued Jan. 4, 1983; and No. 4,477,028, issued Oct. 16, 1984, to John H. Hughes. In these prior art comminuters the rollers are arranged in an upright position and form a comminuting chamber. The roller arrangement is mounted within a housing of some type that surrounds the group of rollers. The material to be broken down is fed into the top of the comminuting chamber and driven orbitally at a speed sufficient to be forced against the comminuting rollers. Puncturing elements are present on the rollers to break the material into smaller pieces by a rolling and puncturing action. The pieces then fall to the bottom of the chamber and exit the chamber through some screening and exit arrangement formed at the bottom of the comminuting chamber. Typically, the exit from the comminuting chamber is formed along the outer perimeter of the base of the housing.

In certain instances, the particles of material being formed in the comminuter remain in a mass that continually moves about the interior of the comminuting chamber and the particles do not move to the lower perimeter of the comminuting chamber so that they can pass through the screening and exit arrangement at the bottom of the comminuter housing. There is a need, therefore, for some means to assist the particles of material in making their way outwardly to the perimeter of the comminuter housing chamber and down to the exit means.

It is, therefore, an object of the present invention to provide a novel structure for the comminuting rolls so that they assist in moving the particles of comminuted material from the interior of the comminuting chamber toward the outer perimeter of the housing surrounding the comminuting rolls. It is another object of this invention to provide such rolls that are easily retrofitted into existing comminuters and that are relatively easy to install and maintain and economical to produce.

SUMMARY OF THE INVENTION

In accordance with the above-stated objects, the present invention provides an improved roll for a comminuter, which is mountable in an upright position along with other rolls in the comminuter in such a manner that the rolls define the comminuting chamber. Each of the rolls is rotatable and at least one of the rolls includes a plurality of exposed radially directed apertures formed in the surface of the roll. The apertures must extend at least a predetermined distance into the body of the roll and, in some cases, may penetrate the roll. In operation, the particulate material from the comminuting chamber will lodge in the holes formed in the comminuter roll and be ejected from the hole, as the roll turns, by the centrifugal force created by the rotation of the roll, forcing the particulate matter to break apart from the mass of material in the center of the comminuter and be expelled outwardly toward the wall of the housing surrounding the comminuter rolls. Once the particulate matter is expelled from the comminuting chamber, it falls to the bottom of the housing in proximity to the exit from the housing to a collection means.

In one embodiment, each of the particle-collecting apertures in the rolls is sleeved with a wear-resistant annular sleeve. In another embodiment of the invention, a predetermined number of the apertures are threaded. A plurality of tooth members, each having a threaded shaft formed thereon, are provided. Each tooth threadably engages one of the threaded apertures to provide the puncturing means of the comminuter.

BRIEF DESCRIPTION OF THE DRAWINGS

It will be understood by those of ordinary skill in the art and others that the objects and advantages of the present invention can be best understood upon reading the ensuing specification when taken in conjunction with the appended drawings wherein:

FIG. 1 is an isometric view, partially exploded, of one embodiment of a comminuter roll made in accordance with the principles of the present invention;

FIG. 2 is a plan view in section of a series of rolls of the type shown in FIG. 1 mounted in a comminuter;

DETAILED DESCRIPTION OF THE PREFERRED EMBODIMENT

Figure 3:
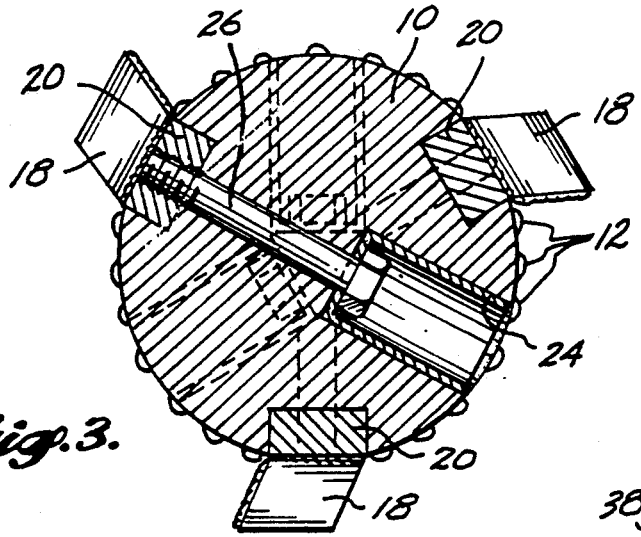
FIG. 3 is a sectional view of the roll shown in FIG. 1.

FIG. 1 shows one embodiment of an abrasive roll for use in a comminuter made in accordance with the principles of the present invention. The roll 10 is essentially cylindrical and has abrasive protrusions 12 formed in its outer surface by some conventional method. Typically, the upper end 11 of the roll is smooth and mounted in a bearing 14 to enable the roll 10 to rotate in a typical installation in a comminuter. FIG. 2 shows a plan view of three identical comminuter rolls, 10*a*, 10*b*, and 10*c*, arranged in a comminuter in the typical fashion, each of the rolls being rotatable independently of the other rolls to contact the product being comminuted. In a typical prior art comminuter, the rolls are arranged in a circular pattern, forming a comminuting chamber inside the circle formed by the rolls and the entire series of rolls is contained within an outer wall, such as the wall 16. The comminuter roll 10 has a plurality of product-engaging tooth members 18 mounted on its outer surface and projecting outwardly from the surface of the roll. The tooth members 18 are mounted in spaced relationship on a tooth-mounting bar 20, which, in turn, is bolted to the roll 10. A series of product pickup holes 22 are also formed in the surface of the roll 10 and have a wear-resistant sleeve 24 press fit into the holes. In the embodiment shown in FIG. 1, the tooth-engaging bars are held to the roll by a bolt 26, which passes through the product pickup holes 22 and through a smaller diameter bolt hole 28 that extends from the innermost portion of the product pickup hole 22 through the roll 10 and threadably engages a threaded mounting hole 30 formed in the tooth-mounting bar 20. An endpiece 32 of the wear-resistant sleeve 24 acts as a washer between the head of the bolt 26 and the roll 10.

As can be seen in FIG. 2, the product pickup hole 22 has a relatively large open volume and, in operation of the roll, particles of the product being comminuted will enter the product pickup hole 22 as the product swirls within the comminuting chamber and the rolls rotate with the comminuting action. Typically, the product will enter the hole 22 when the hole is in the position of the center roll 10*b* in FIG. 2. As the roll rotates, the product will be discharged from the hole in the vicinity of the outer wall 16 by the centrifugal force generated by the rolls' rotation. In this way, the product is shifted from the center of the comminuting chamber to the perimeter of the comminuter housing. A typical comminuter will then have a discharge chute at the bottom of the comminuter, adjacent the outer wall 16, as shown in the patent to Hughes, U.S. Pat. No. 4,477,028. The action of the product in entering the pickup hole and being discharged from the pickup hole adjacent the wall 16 aids in breaking up the mass of comminuted particles within the comminuting chamber and keeps the particles flowing toward the outer perimeter of the comminuter housing, thereby assisting the flow of particulate matter out of the comminuter.

Figure 5:
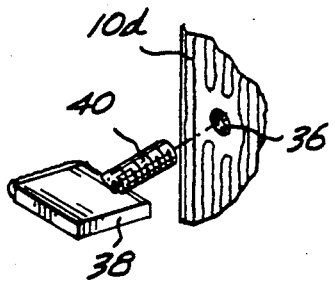
FIG. 5 is an isometric view of one embodiment of a tooth member and a portion of a second embodiment of a comminuter roll made in accordance with the principles of the present invention.
Figure 6:
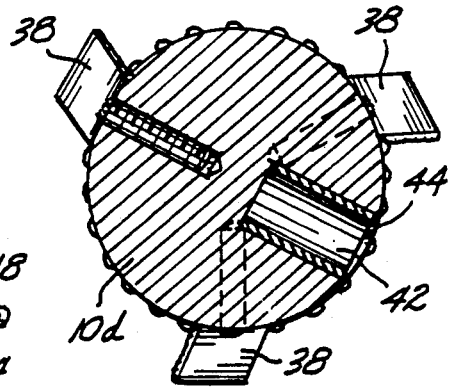
FIG. 6 is a plan view in section of the comminuter roll made in accordance with the principles of the present invention shown in FIG. 5 with the tooth members of FIG. 5 installed.
Figure 4:
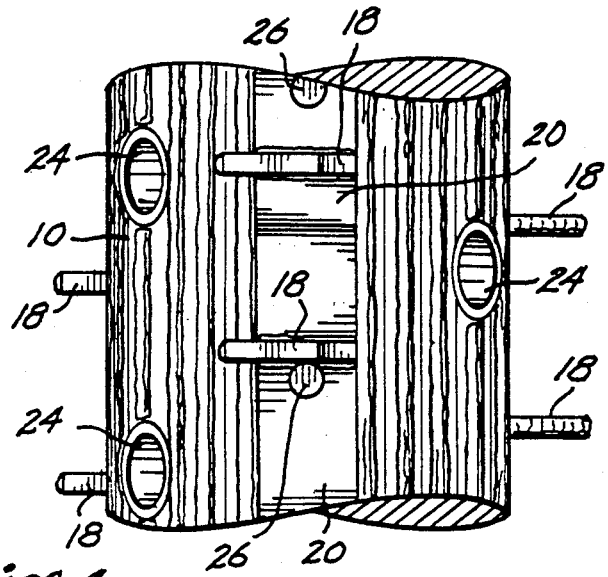
FIG. 4 is a front elevational view of the roll shown in FIG. 3.

Another embodiment of a comminuting roll 10*d* having a product pickup hole formed therein, but mounting the tooth members in a different manner, is shown in FIGS. 5 and 6. In the embodiment of FIGS. 5 and 6, a series of threaded holes 36 is formed directly in the surface of the roll 10*d* and each tooth member 38 has a threaded stud 40 affixed to it that threadably engages the hole 36 in the surface of the roll in order to hold the tooth member in place. The product pickup holes 42, then, are separate from the tooth-mounting holes 36 and there is no communication between them, as shown in FIG. 6. A wear-resistant sleeve 44 can be press fit into the product pickup holes to provide a wear bushing that can be easily replaced from time to time, as the comminuted product wears down the sleeve 44, thereby reducing the effort necessary to refurbish the roll, since it would not be necessary to rework the product pickup holes 42 but, simply, to replace the sleeves 44.

Figure 7:
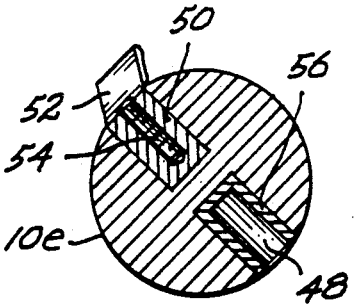
FIG. 7 is a sectional plan view of a third embodiment of the comminuter roll made in accordance with the principles of the present invention.

Another method that can be used to mount the teeth is shown in FIG. 7. In the embodiment of FIG. 7 a plurality of holes 48 are formed in the roll 10*e*. A predetermined number of the holes 48 have a plug 50 press fit into them. The plug 50 has a threaded hole formed in it to transform the product pickup hole 48 into a tooth-mounting hole. A tooth member 52 has a threaded stud 54 affixed to it that threadably engages the threaded hole in the plug 50. The remaining holes can be fitted with a wear-resistant sleeve 56 as discussed earlier.

Figure 8:
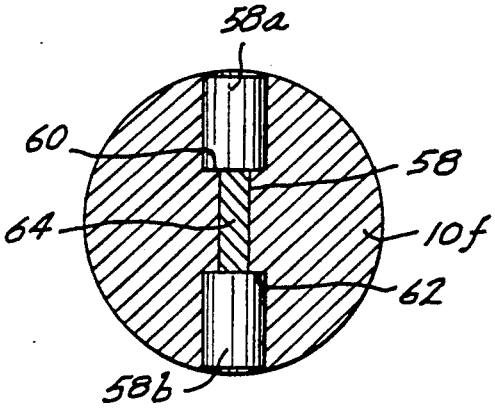
FIG. 8 is a sectional plan view of another embodiment of a roll made in accordance with the principles of the present invention.

Another embodiment of the comminuter roll of the present invention is shown in FIG. 8. The roll 10*f* has a series of radially directed holes 58 formed in it, one of which is shown in FIG. 8, extending through the roll. The opposite ends 58*a* and 58*b* of the hole are countersunk to a predetermined depth leaving shoulders 60 and 62, respectively, at the interior end of the countersunk portion. The portions 58*a* and 58*b* form product pickup holes of the type described above. If desired, the central portion of the hole 58 that is not countersunk can be plugged with a press fit plug 64 or can be left open. Also, either or both of the portions 58*a* and 58*b* can be used to mount teeth to the roll.

The invention, therefore, teaches the formation of a plurality of product pickup holes in the surface of a comminuting roll used in a typical comminuter. The product pickup holes can serve an additional function as an entry point for bolts holding a tooth-mounting bar having a series of teeth projecting obliquely from it to provide the product-engaging teeth on the surface of the roll. Alternatively, the product pickup holes can be completely independent of any tooth-mounting means and the tooth members can be mounted simply by threadably engaging a threaded stud, affixed to each of the tooth members, with a threaded hole formed in the roll, separate from the product pickup holes. One other embodiment of the invention provides for the transformation of some of the product pickup holes into tooth-mounting holes by inserting a plug into selected ones of the product pickup holes with the plug having a threaded tooth-mounting hole formed in it. The stud on the tooth member then threadably engages the tooth-mounting hole in the plug, mounting the tooth to the roll. The product pickup holes need not, but may, extend through the roll. It can be seen, therefore, that several changes can be made to the illustrated and preferred embodiments of the invention, while remaining within the scope of the present invention. The present invention should therefore be defined solely with reference to the appended claims.

The embodiments of the invention in which an exclusive property or privilege is claimed are defined as follows:

1. A method of comminuting, comprising the steps of:

introducing material to be comminuted into a comminuting chamber defined by a series of upright abrasive rolls mounted in a closed geometric pattern;

maintaining the material to be comminuted in contact with the abrasive rolls to abrade the material into particles;

collecting the particles in apertures formed in the surface of at least one of said abrasive rolls when the apertures are adjacent said comminuting chamber; and, rotating said at least one abrasive roll about a vertical axis at a speed sufficient to produce a force directed radially outward of said at least one abrasive roll sufficient to dislodge said particles from said apertures when said apertures are positioned away from said comminuting chamber and deposit said particles in a location outside said comminuting chamber.

2. The method of claim 1, wherein:

the collecting step includes collecting the particles in apertures formed in the surface of each of the abrasive rolls; and, the rotating step includes rotating each of the rolls at a speed sufficient to dislodge the particles from the apertures and deposit them in a location outside the comminuting chamber.

* * * * *